US005809628A

United States Patent [19]

Davis et al.

[11] Patent Number: 5,809,628

[45] Date of Patent: Sep. 22, 1998

[54] LUBRICATING OIL COMPOSITIONS USED IN METAL FORMING OPERATIONS

[75] Inventors: James Earl Davis, Sturgis; William J. Hamilton, Burr Oak, both of Mich.

[73] Assignee: Oak International, Inc., Sturgis, Mich.

[21] Appl. No.: 616,247

[22] Filed: Mar. 15, 1996

[51] Int. Cl.[6] ..... B23P 25/00; C01L 5/00

[52] U.S. Cl. ..... 29/458; 585/10

[58] Field of Search ..... 29/458; 585/10; 72/42; 228/221, 262.51

[56] References Cited

U.S. PATENT DOCUMENTS

| | | | |
|---|---|---|---|
| 3,432,434 | 3/1969 | Armstrong et al. . | |
| 3,549,537 | 12/1970 | Brewster et al. . | |
| 3,855,135 | 12/1974 | Newingham et al. . | |
| 3,919,098 | 11/1975 | Altgelt . | |
| 3,965,018 | 6/1976 | Heilman et al. . | |
| 3,984,599 | 10/1976 | Norton . | |
| 4,060,492 | 11/1977 | Yasui et al. | 585/10 |
| 4,078,010 | 3/1978 | Prillieux et al. . | |
| 4,213,868 | 7/1980 | Bitely, Jr. et al. | 252/11 |
| 4,239,638 | 12/1980 | Beretta et al. | 585/10 |
| 4,882,034 | 11/1989 | Tack et al. | 585/10 |
| 5,116,522 | 5/1992 | Brown et al. . | |
| 5,284,595 | 2/1994 | Emert et al. | 585/10 |
| 5,290,461 | 3/1994 | Chung et al. | 585/10 |
| 5,306,416 | 4/1994 | Le et al. . | |
| 5,389,452 | 2/1995 | Nakajima et al. . | |

*Primary Examiner*—A. L. Pitts
*Assistant Examiner*—Tisa L. Stewart
*Attorney, Agent, or Firm*—Flynn, Thiel, Boutell & Tanis, P.C.

[57] ABSTRACT

A superior lubricating oil composition which can be used in metal forming operations is made up of an α-olefin and a hydrotreated naphthenic distillate. This lubricating oil composition is particularly suited for use in a vacuum de-oiling brazing process in that it improves tool life, reduces residue deposits on forming dies and completely vaporizes at a low vacuum brazing temperature.

17 Claims, 1 Drawing Sheet

LUBRICATING OIL COMPOSITIONS USED IN METAL FORMING OPERATIONS

BACKGROUND OF THE INVENTION

1. Field of the Invention

This invention relates to lubricating oil compositions containing an α-olefin and a hydrotreated naphthenic distillate. These lubricating oil compositions are particularly advantageous when used in metal forming and vacuum brazing processes.

2. Description of the Prior Art

In recent years, the manufacture of metal parts having complicated configurations have been achieved by a two-step process. In the first step, a metal blank is introduced into a forming die where the metal blank is shaped to a desired configuration and a vacuum brazing process where the shaped metal pieces are bonded to each other to form a desired assembly. During the forming operation, the metal blanks are typically coated with a lubricating oil composition in order to reduce the friction between the forming tool and the metal blank and also to aid in removal of the formed metal piece from the die. The formed metal piece is then introduced into a vacuum furnace where it is brazed under a vacuum with other formed pieces to form a desired assembly.

The lubricant used in the forming operation is still present on the formed metal piece during the vacuum brazing process and it is desirable that the lubricant completely vaporize during the brazing. If the formed metal piece is made of aluminum, the brazing temperature is approximately 600°–800° F. If the lubricant does not completely vaporize during the brazing process, problems may occur in that solid deposits may form on the metal pieces which interfere with the brazing of the pieces to each other, thereby creating weakened points of attachment. Additionally, increased furnace maintenance may occur as solids also tend to build up on the furnace chamber wall since the vacuum pumps are not capable of removing solid matter. The removal of these solids entails a shut-down for approximately 48 hours in order to adequately clean the furnace. As such, there is a need for a lubricating oil composition which has adequate friction properties when used as a coating for metal blanks being formed and yet will evaporate at low temperatures, such as 300° F. when the formed metal is aluminum.

The current lubricating oil used in forming and vacuum brazing of aluminum parts is Circle-Prosco #402H-D which is made up of a blend of a naphthenic distillate (CAS 64742-53-6) and methyl lardate (CAS 68990-52-3). This lubricating oil has performance deficiencies in that it does not completely vaporize at low temperatures associated with aluminum brazing and tends to form deposits on the brazed parts and the evaporator walls during the evaporation brazing process.

U.S. Pat. No. 3 965 018 to Heilman et al shows a process for preparing a concentrate of a poly-α-olefin in a lubricating oil base stock. In this process, a hydro-treated lubricating oil base stock is subjected to hydrogen treatment in the presence of a Ziegler-Natta type catalyst and then this conditioned, hydrotreated lubricating oil base stock used as a reaction medium for polymerizing an α-olefin. The resulting solution of the poly(1-alkene) and the hydrotreated lubricating oil base stock is a concentrate which is used as an additive in the preparation of multi-viscosity graded motor oils.

U.S. Pat. No. 3,432,434 to Armstrong et al shows an emulsion lubricant for metal-rolling operations, particularly used in the cold-rolling of aluminum alloys, made up of a water and oil emulsion containing an alkyl aromatic compound. Naphthalene is disclosed as being an aromatic compound suitable for use in the emulsion.

U.S. Pat. No. 3,549,537 to Brewster et al discloses insulating oil compositions employed as transformer oils which can be naphthenic oil distillates modified through the use of a mono-olefin, an alkyl halide or an aryl halide.

Bryer et al shows a lubricant composition made up of an unhydrorefined naphthenic distillate, a hydrocracked lube oil and an oxidation inhibitor. As an additional component when used as a textile oil or refrigeration oil, this composition can also contain high viscosity index hydrocracked oils and/or hydrogenated polyolefin oils.

U.S. Pat. No. 3,919,098 to Altgelt shows a cutting oil composition which can comprise a naphthenic oil and an anti-fog additive selected from polyisobutene or poly-n-butene. These cutting oil compositions are said to reduce the fog generated during grinding in high-speed metal operations.

U.S. Pat. No. 3,984,599 to Norton shows a lubricant coating composition which can be applied to metal sheeting during a preliminary stage of manufacture and remain in place on the sheeting during storage or transport and finally serve as a lubricant during metal forming of the sheeting. These coating compositions are made up of a mineral oil having a viscosity of at least 100 SUS at 100° F., a paraffin wax, a wax crystal modifier and an extreme pressure agent. The mineral oil is preferably a naphthenic oil and single olefins can be the extreme pressure agent.

U.S. Pat. No. 4,078,010 to Prillieux et al shows oils which can be used as hydraulic fluids in mechanical transmissions and hydraulic shock-absorbers. These compositions are produced by oligomerising an olefin selected from propylene, isobutylene, n-butenes and mixtures thereof in the liquid phase in the presence of a Friedel Crafts catalyst and hydrogenating the oligomer or a fraction thereof formed. A naphthenic oil can be incorporated with the paraffinic oil in order to give the final oil the desired swelling power with a particular elastomer with which it is to be used.

Although the above-discussed references all show lubricating oil compositions which are said to have special properties with respect to the service that they are used, none of these oil compositions offer both the high lubrication properties needed during the forming of a metal part and the relatively low vaporization temperature which would enable the lubricating oil composition to be readily vaporized at a low temperature during vacuum brazing. The present invention has been arrived at in order to address these problems.

SUMMARY OF THE INVENTION

It has now been found that a lubricating oil composition containing an α-olefin and a hydrotreated naphthenic distillate has properties which makes it acceptable as a lubricant for metal forming and vacuum brazing operations. The lubricating oil composition of the present invention preferably contains an α-olefin having from 14 to 18 carbon atoms and a naphthenic distillate having a viscosity of from 5 to 25 cst at 40° C. and a flashpoint of from 235° to 330° F. The composition can comprise from 3 to 97 weight percent of the α-olefin and from 97 to 3 weight percent of the hydrotreated naphthenic distillate.

The present invention also contemplates the use of the lubricating oil composition described above and a method of forming metal parts in which a metal blank is coated with the lubricating oil composition, inserted in a forming die and pressed into a desired configuration. The formed metal piece can then be introduced into a vacuum furnace and vacuum brazing performed on the formed metal piece to join it to other formed metal pieces and form an assembly. Due to the advantageous properties associated with the inventive lubricating oil composition, tool wear is reduced during the forming operation and the lubricant can be completely removed from the metal surfaces during the vacuum brazing process.

The compositions of the present invention can be applied to a variety of metals and is particularly suitable for use in working and vacuum brazing aluminum.

DETAILED DESCRIPTION OF THE INVENTION

Figure 1:
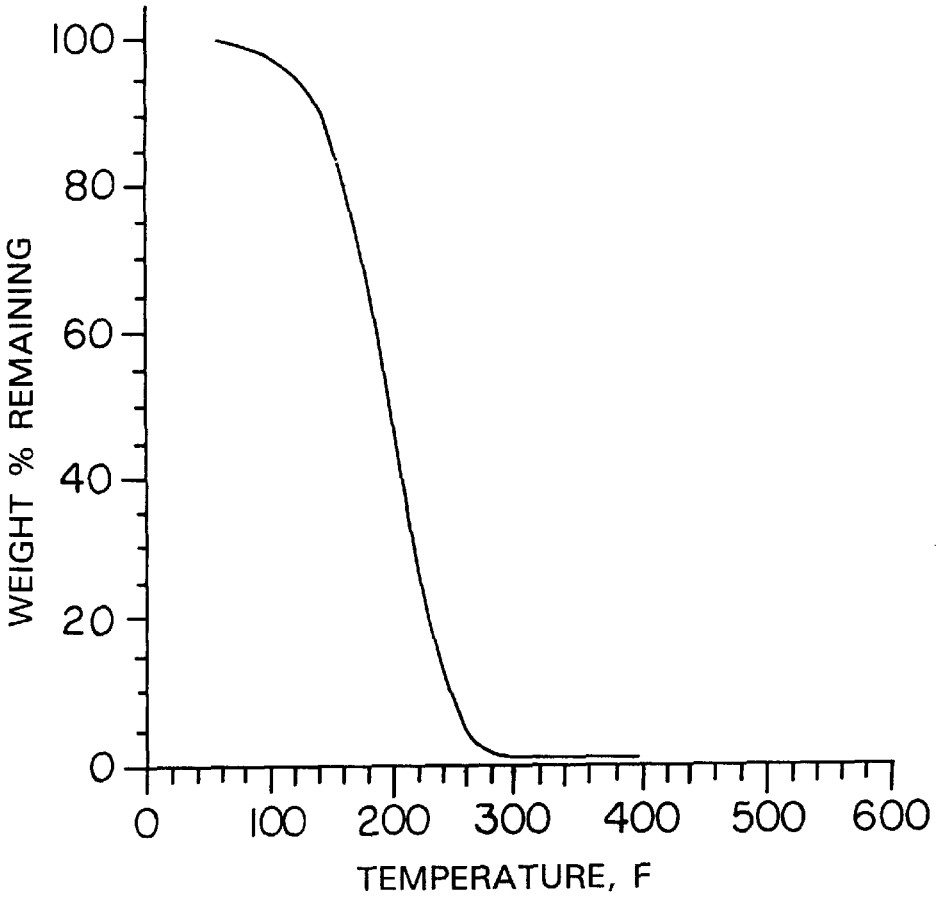
FIG. 1 is a vaporization curve of a lubricating oil composition according to the present invention in which the remaining weight percent is plotted against temperature.

The novel lubricating oil composition of the present invention is made up of a hydrotreated naphthenic distillate and an α-olefin. The hydrotreated naphthenic distillate preferably has a viscosity of from 5 to 25 cst at 40° C. and a flashpoint of from 235° to 330° F. Examples of hydrotreated naphthenic distillates which can be used in the present invention are HydroCal II® naphthenic oils sold by Calumet Refining Co. A particularly preferred hydrotreated naphthenic distillate has a viscosity of 5.5 cst at 40° C. and a flashpoint of 235° F. In the lubricating oil composition of the present invention, the naphthenic distillate can be present in an amount of from 3 to 97 weight percent with about 50 weight percent being particularly preferred. The hydrotreated naphthenic distillate can be a single oil or a blend of oils so long as it has the properties necessary for achieving the desired results of the present invention.

The α-olefin used in the present invention can be straight-chained or branched and preferably contains from 11 to 18 carbon atoms. More preferably, the α-olefin has from 14 to 18 carbon atoms with a straight chain α-olefin having 14 carbon atoms being most preferred. A blend of α-olefins can serve as the α-olefin component of the present invention as long as the blend has an average number of carbon atoms of from 11 to 18. The α-olefin can be combined with the hydrotreated naphthenic distillate in an amount about from 3 to 97 weight percent based on the total weight of the lubricating oil composition. More preferably, the weight content of the α-olefin is in the range of from 30 to 70 weight percent with a weight content of 50 weight percent being especially preferred.

The lubricating oil compositions of the present invention can also be used with suitable additives such a as rust inhibitors, viscosity index improvers, extreme-pressure additives, anti-wear additives and oxidation inhibitors.

The present invention is illustrated but in no way limited by reference to the following Examples.

EXAMPLE 1

A lubricating oil composition according to the present invention was prepared by blending a hydrotreated naphthenic distillate having a viscosity of 5.5 cst at 40° C. and a flashpoint of 235° F. (Hydrocal II® by Calumet Refining Co.) with a straight chain α-olefin having 14 carbon atoms in a 1:1 weight ratio. The lubricating properties of this composition were evaluated by conducting a Falex seizure test according to ASTM-D3233, Method A. The lubricating oil composition had an initial temperature of 72° F. and a final temperature of 152° F. The results are shown in Table 1.

COMPARATIVE EXAMPLE 1

A comparative lubricating oil composition made up of a blend of a naphthenic distillate and methyl lardate (Circle-Prosco #402H-D) was evaluated for its lubricating properties by conducting a Falex seizure test according to ASTM-D3233, Method A. The comparative lubricating oil composition had an initial temperature of 72° F. and a final temperature of 162° F. The results are shown in Table 1.

TABLE 1

| Example 1 | | Comparative Example 1 | |
|---|---|---|---|
| Load (lbs.) | Torque (lb-in) | Load (lbs.) | Torque (lb-in) |
| 350 | 13 | 350 | 10 |
| 500 | 18 | 500 | 11 |
| 750 | 23 | 750 | 20 |
| 1000 | 28 | 1000 | 28 |
| 1250 | 33 | 1250 | 33 |
| 1500 | 37 | 1500 | 38 |
| 1750 | 40 | 1750 | 42 |
| 2000 | 44 | 2000 | 48 |
| 2250 | 48 | 2250 | 50 |
| 2500 | 52 | 2500 | 53 |
| 2750 | 54 | 2750 | 56 |
| 3000 | 55 | 3000 | 58 |
| 3250 | 55 | 3250 | 60 |
| 3500 | 55 | 3500 | 63 |
| 3750 | 55 | 3750 | 63 |
| 4000 | 55 | 4000 | 63 |
| 4250 | 55 | 4250 | 63 |
| 4500 | 56 | 4500 | 63 |

As can be seen from Table 1, the lubricating oil composition of Example 1 had superior lubricating properties over the lubricating oil composition of Comparative Example 1.

EXAMPLE 2

The lubricating oil composition of Example 1 was heated in a vacuum at an increasing temperature of 45° F./min. to determine the temperature at which it vaporized. As shown in FIG. 1, the oil composition of the present invention completely vaporized at a temperature of approximately 285° F. As such, the lubricating oil composition of the present invention is especially suited for use in vacuum brazing processes.

COMPARATIVE EXAMPLE 2

Figure 2:
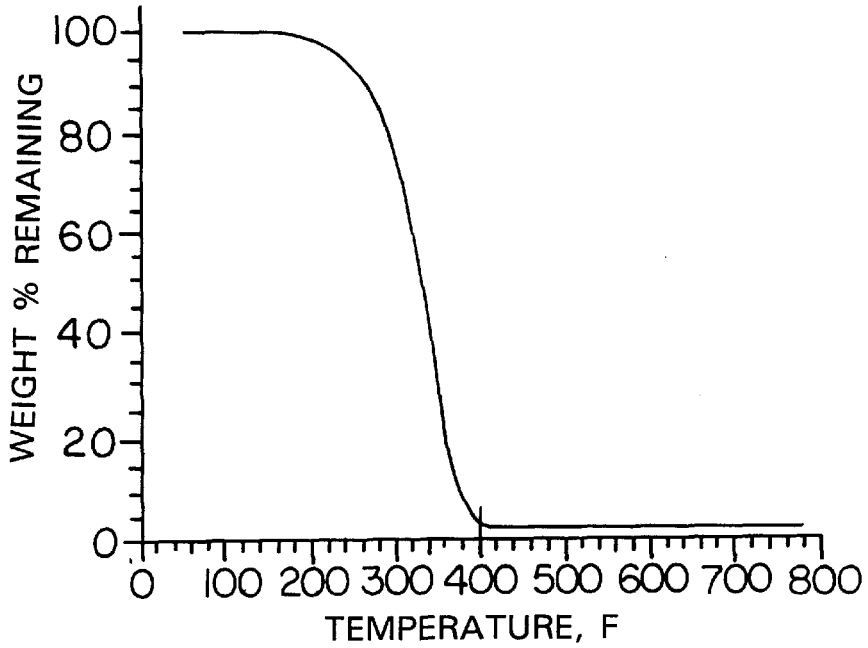
FIG.2 PRIOR ART
FIG. 2 is a vaporization curve of a comparative lubricating oil composition in which the remaining weight percent is plotted against temperature.

The lubricating oil composition of Comparative Example 1 was heated under conditions identical to that of Example 2 to determine the temperature at which it vaporized completely. The results are shown in FIG. 2. The comparative lubricating oil composition did not completely vaporize until a temperature of approximately 400° F. Due to the high vaporization temperature of the comparative lubricating oil composition, it may present problems during a vacuum brazing process by forming solid deposits on metal pieces to be brazed and the furnace.

The lubricating oil compositions of the present invention have an advantageous combination of high lubricating properties and low vaporization temperature. These properties make them especially suited for use in metal forming and vacuum brazing processes.

The embodiments of the invention in which an exclusive property or privilege is claimed are defined as follows:

1. In a method of forming metal parts in which a metal blank is inserted into a forming die and pressed into a desired configuration, the improvement comprising coating said metal blank with a composition comprising an α-olefin having from 11 to 18 carbon atoms and a hydrotreated naphthenic distillate.

2. The method of claim 1, wherein the hydrotreated naphthenic distillate has a viscosity of from 5 to 25 cst at 40° C. and a flashpoint of from 235° to 330° F.

3. The method of claim 1, wherein said composition comprises from 3 to 97 wt. % of the α-olefin and from 97 to 3 wt. % of the hydrotreated naphthenic distillate.

4. The method of claim 1, wherein said α-olefin has from 14–18 carbon atoms.

5. The method of claim 1, wherein said α-olefin has 14 carbon atoms.

6. The method of claim 1, wherein said naphthenic distillate has a viscosity of 5.5 cst at 40° C. and a flashpoint of 235° F.

7. The method of claim 1, wherein said composition comprises 50 wt. % of an α-olefin having 14 carbon atoms and 50 wt. % of a naphthenic distillate having a viscosity of 5.5 cst at 40° C. and a flashpoint of 235° F.

8. The method of claim 1, wherein said metal blank is made of aluminum.

9. In a method of vacuum brazing to attach one metal component to another metal component, the improvement comprising said one metal component having provided thereon a lubricating composition comprising an α-olefin having from 11 to 18 carbon atoms and a hydrotreated naphthenic distillate.

10. The method of claim 9, wherein said hydrotreated naphthenic distillate has a viscosity of from 5 to 25 cst at 40° C. and a flashpoint of from 235° to 330° F.

11. The method of claim 9, wherein said composition comprises from 3 to 97 wt. % of the α-olefin and from 97 to 3 wt. % of the hydrotreated naphthenic distillate.

12. The method of claim 9, wherein said α-olefin has from 14–18 carbon atoms.

13. The method of claim 9, wherein said naphthenic distillate has a viscosity of 5.5 cst at 40° C. and a flashpoint of 235° F.

14. The method of claim 9, wherein said α-olefin has 14 carbon atoms.

15. The method of claim 9, wherein said composition comprises 50 wt. % of an α-olefin having 14 carbon atoms and 50 wt. % of a naphthenic distillate having a viscosity of 5.5 cst at 40° C. and a flashpoint of 235° F.

16. The method of claim 9, wherein said metal component is made of aluminum.

17. In a method of forming metal parts in which a metal blank is inserted into a forming die and pressed into a desired configuration to form a first metal component and the first metal component is then attached to another metal component by vacuum brazing, the improvement comprising said metal blank and said first metal component having provided thereon a lubricating composition comprising an α-olefin having from 11 to 18 carbon atoms and a hydrotreated naphthenic distillate.

* * * * *